US012550998B2

(12) United States Patent
Chung et al.

(10) Patent No.: US 12,550,998 B2
(45) Date of Patent: Feb. 17, 2026

(54) COSMETIC CASE FOR EASY REPLACEMENT AND ASSEMBLY OF PALLETS

(71) Applicant: CTK CO., LTD., Seoul (KR)

(72) Inventors: In Yong Chung, Seoul (KR); Won Eui Lee, Seoul (KR); In Young Um, Seoul (KR); Kyung Ho Kang, Suwon-si (KR)

(73) Assignee: CTK CO., LTD., Seoul (KR)

( * ) Notice: Subject to any disclaimer, the term of this patent is extended or adjusted under 35 U.S.C. 154(b) by 69 days.

(21) Appl. No.: 18/082,206

(22) Filed: Dec. 15, 2022

(65) Prior Publication Data

US 2023/0270234 A1 Aug. 31, 2023

(30) Foreign Application Priority Data

Feb. 28, 2022 (KR) ..... 10-2022-0025678

(51) Int. Cl.
*A45D 40/22* (2006.01)
*A45D 40/24* (2006.01)

(52) U.S. Cl.
CPC ..... *A45D 40/22* (2013.01); *A45D 40/24* (2013.01)

(58) Field of Classification Search
CPC .... A45D 33/006; A45D 33/008; A45D 40/22; A45D 40/24; A45D 33/003; A45D 40/222; A45D 40/225
See application file for complete search history.

(56) References Cited

U.S. PATENT DOCUMENTS 4,421,127 A * 12/1983 Geer ..... A45D 40/22 206/823
5,353,947 A * 10/1994 Zinnbauer ..... A45D 40/22 D28/83
2014/0261530 A1* 9/2014 McNamara ..... A45D 40/00 132/286
2016/0270507 A1* 9/2016 Thompson ..... A45D 33/006
2022/0031042 A1* 2/2022 Sobol ..... A45D 40/22
2022/0408898 A1* 12/2022 Cheng ..... A45D 33/006
2023/0130828 A1* 4/2023 Cheng ..... A45D 33/20 132/287

FOREIGN PATENT DOCUMENTS

FR 2943511 * 10/2010
JP 3681421 B2 8/2005
KR 20-0165353 Y1 1/2000
KR 20-0372921 Y1 1/2005
KR 10-2016-0062242 A 6/2016
WO WO 2011072426 * 6/2011
WO WO-2011072426 A1 * 6/2011 ..... A45D 33/008
WO WO-2015155228 A1 * 10/2015 ..... A45D 33/006

OTHER PUBLICATIONS

Machine Translation of Drugeon (Year: 2010).*

* cited by examiner

*Primary Examiner* — Thomas C Barrett
*Assistant Examiner* — Sarah Woodhouse
(74) *Attorney, Agent, or Firm* — Bridgeway IP Law Group, PLLC; Jihun Kim

(57) ABSTRACT

Provided is a cosmetic container including: a container body having a compartment frame formed on top thereof to provide one or more compartmented exposed spaces and a mounting space open downward; a cap openable and closable with respect to the container body by means of a hinge disposed on one side thereof; and a pallet coupled or separated to or from the mounting space of the container body and having one or more compartmented cosmetic material filling spaces filled with cosmetic materials.

5 Claims, 8 Drawing Sheets

COSMETIC CASE FOR EASY REPLACEMENT AND ASSEMBLY OF PALLETS

CROSS-REFERENCE TO RELATED APPLICATION

This application claims priority under 35 USC 119 to Korean patent application No. 10-2022-0025678 filed on Feb. 28, 2022, the entire contents of which is incorporated by reference herein.

BACKGROUND OF THE INVENTION

Field of the Invention

The present invention relates to a cosmetic container with a pallet easily detachable therefrom, and more specifically, to a cosmetic container with a pallet easily detachable therefrom that is capable of having elastic control pieces facingly formed on both side walls of the pallet and elastic control grooves facingly formed on the inner surfaces of the side walls of a container body with a mounting space open on the underside thereof, so that in a packaging line, in a state where a cap is closed with respect to the container body, the container body can be directly pressurized against the pallet filled with cosmetic materials, thereby completing the packaging process of the cosmetic container, and if it is desired to replace the pallet with a refill pallet, the elastic control pieces are artificially released elastically from the coupled states to the underside of the container body, thereby optimizing the packaging conveniences of a product and ensuring easy replacement of the pallet with the refill pallet.

Background of the Related Art

In the case of a conventional cosmetic container with a pallet, generally, the pallet is coupled to top of a container body.

In the case of the conventional cosmetic container, accordingly, if a product is received in a state where a cap of the cosmetic container is closed with respect to the container body, the cap is open to fill the pallet with cosmetic materials, and otherwise, after dishes filled with the cosmetic materials are bonded to the pallet, the cap is closed with respect to the container body, so that packaging work is inconvenient and a toll processing cost is increased.

Further, upon the packaging of the product, the dishes filled with the cosmetic materials are bonded to the pallet by means of a double-sided tape, an adhesive, or a hot-melt adhesive, and accordingly, the pallet cannot be replaced with a refill pallet, thereby causing environmental problems such as the waste of resources, environmental pollution, and the like.

Moreover, the dishes are fixedly bonded integrally to the pallet, thereby making it hard to separately collect the dishes and needing additional labor, time, and cost for the separate collection.

To solve such problems, a compact refill container detachable mounting structure is disclosed in Korean Patent No. KR20-0372921 Y1, but according to the conventional compact refill container detachable mounting structure, a detachable piece is formed only on one side of a storage dish, while a long protrusion is being formed on the other side of the storage dish and locked onto a support protrusion of an accommodation hole of a container body, so that the storage dish is detachable from the accommodation hole of the container body only in a downward direction of the accommodation hole, and further, after one side long protrusion is first locked onto the support projection of the accommodation hole, the other side detachable piece is elastically pushed and fitted or elastically operates to thus couple or separate the storage dish to or from the container body, thereby causing many inconveniences. In the case of the above-mentioned conventional technology, moreover, if a refill container is received in a state where a cap is closed with respect to the container body, it is impossible to directly couple the container body to the storage dish, and thus, the storage dish is always coupled to the container body on the bottom of the accommodation hole. Accordingly, the storage dish is first coupled to the accommodation hole of the container body, and next, the cap is open with respect to the container body. After that, a cosmetic material is filled in the storage dish, and the cap is closed with respect to the container body, thereby completing the packaging process. As a result, it is very inconvenient that the cosmetic material is filled in the storage dish or the product is packaged, and because of the addition of the coupling and packaging processes of the product, further, the time required for packaging work is also increased.

SUMMARY OF THE INVENTION

Accordingly, the present invention has been made in view of the above-mentioned problems occurring in the related art, and it is an object of the present invention to provide a cosmetic container with a pallet easily detachable therefrom that is capable of having elastic control pieces facingly formed on both side walls of the pallet and elastic control grooves facingly formed on the inner surfaces of the side walls of a container body with a mounting space open on the underside thereof, so that in a packaging line, in a state where a cap is closed with respect to the container body, the container body can be directly pressurized against the pallet filled with cosmetic materials, thereby completing the packaging process of the cosmetic container, and if it is desired to replace the pallet with a refill pallet, the elastic control pieces are artificially released elastically from the coupled states to the underside of the container body, thereby optimizing the packaging conveniences of a product and ensuring easy replacement of the pallet with the refill pallet.

To accomplish the above-mentioned objects, according to the present invention, there is provided a cosmetic container including: a container body having a compartment frame formed on top thereof to provide one or more compartmented exposed spaces and a mounting space open downward; a cap openable and closable with respect to the container body by means of a hinge disposed on one side thereof; and a pallet coupled or separated to or from the mounting space of the container body and having one or more compartmented cosmetic material filling spaces filled with cosmetic materials, wherein the pallet has elastic control pieces facingly disposed on both side walls thereof, and the container body has elastic control grooves facingly formed on the inner surfaces of the side walls thereof correspondingly to the elastic control pieces, so that in a state where the cap is closed, the container body is directly pressurized against the pallet to allow the mounting space open downward to be coupled to the pallet, and as the elastic control pieces are artificially released from the coupled states thereof, the pallet is separable from the mounting space of the container body and replaced with a refill pallet.

According to the present invention, desirably, the elastic control pieces may include elastic support pieces spaced apart from both side facing walls of the pallet and having freely extending bottom ends in a vertical direction, elastic locking projections protruding from the outer peripheral surfaces of the elastic support pieces, and inclined support surfaces formed on tops of the elastic locking projections, and the elastic control grooves may be adapted to allow the elastic locking projections to be elastically locked and unlocked thereon and therefrom and have initial inclined entry portions with inclined surfaces corresponding to the inclined support surfaces formed on tops of the elastic locking projections, so that the mounting space of the container body is directly pressurized against top of the pallet, and otherwise, when the pallet is pushed and fitted to the open underside of the mounting space, the inclined support surfaces formed on tops of the elastic locking projections slide along the initial inclined entry portions and come into contact with the elastic control grooves, thereby allowing the elastic control pieces to be elastically locked onto the elastic control grooves.

According to the present invention, desirably, cosmetic materials, which may be filled in the cosmetic material filling spaces of the pallet, may be filled directly or in dishes separately prepared.

According to the present invention, desirably, the cosmetic material filling spaces of the pallet may be formed correspondingly to the exposed spaces formed on the compartment frame of the container body.

According to the present invention, desirably, the pallet may have locking edges extending outward from the outer sides of the underside thereof, and the container body may have base stepped projections formed stepped inward by the thicknesses of the locking edges on the inner surfaces of the open underside of the mounting space to insertedly seat the locking edges thereonto.

According to the present invention, desirably, the areas of the cosmetic material filling spaces of the pallet may be larger than the areas of the exposed spaces of the container body, so that the edges of the cosmetic materials accommodated in the cosmetic material filling spaces or tops of the dishes for filling the cosmetic materials may be locked onto the underside of the compartment frame of the container body and thus naturally prevented from escaping upward.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
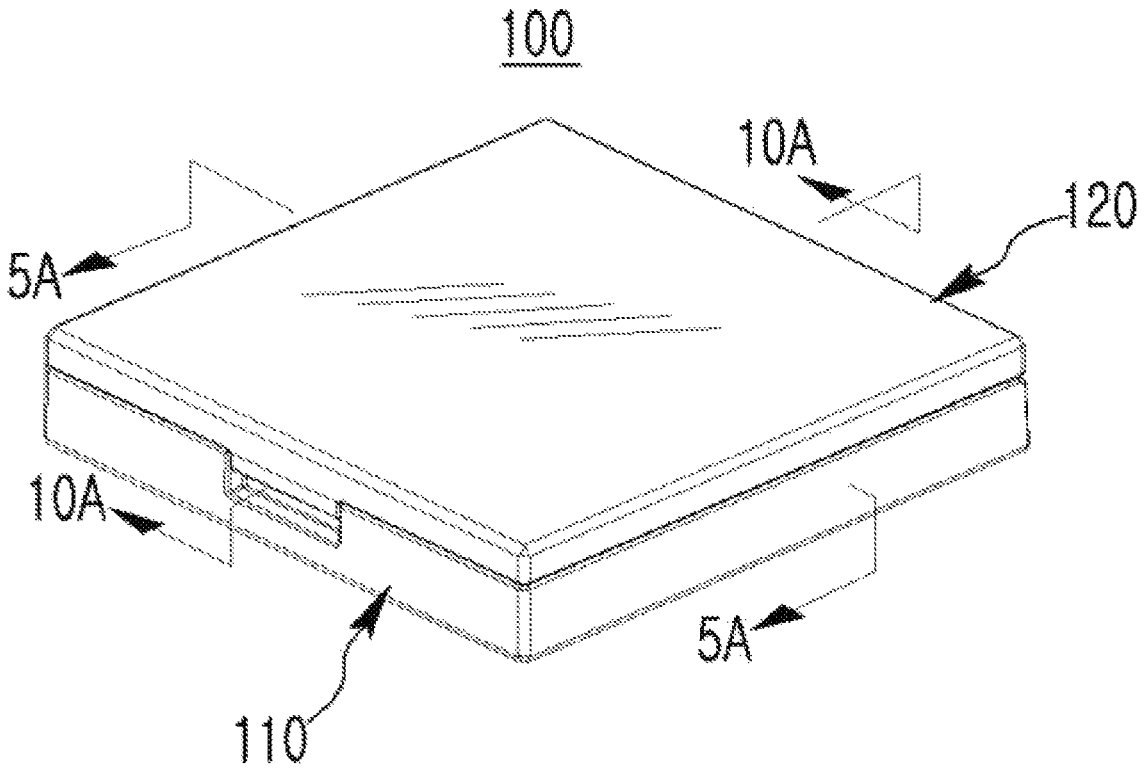
FIG. 1 is a perspective view showing a cosmetic container according to the present invention, to which a pallet is coupled.
Figure 2:
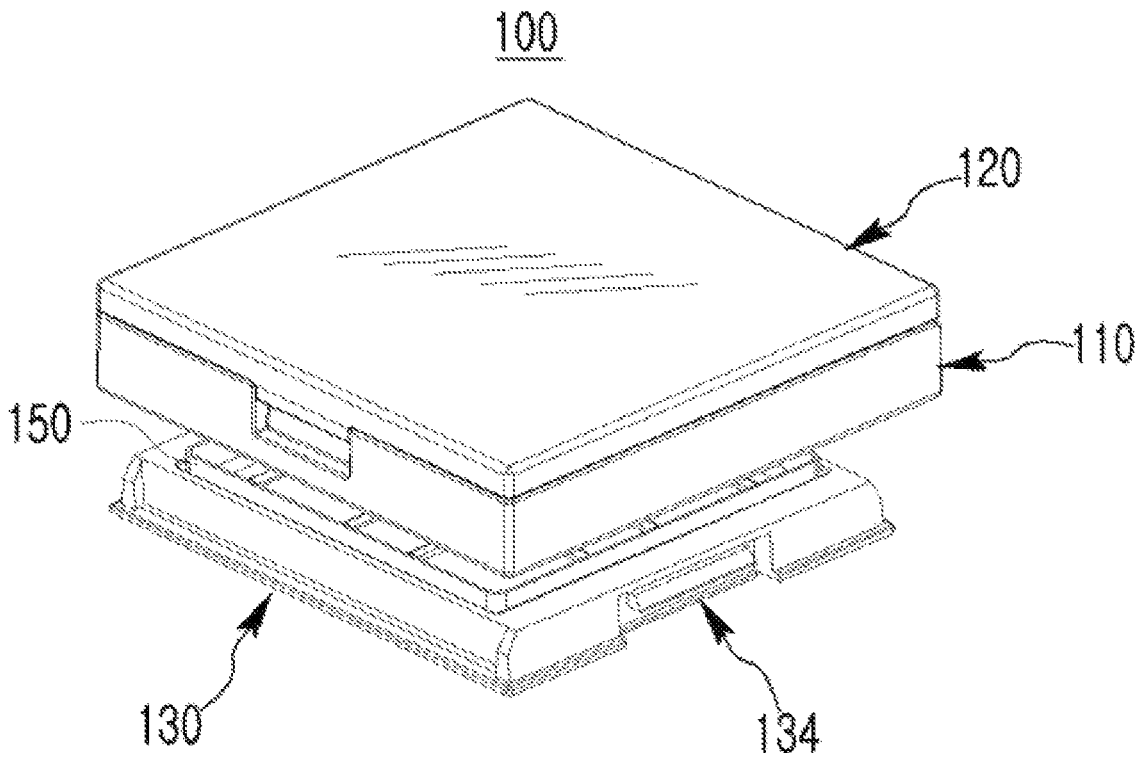
FIG. 2 is a perspective view showing the cosmetic container according to the present invention, from which the pallet is separated.

Hereinafter, embodiments of the present invention will be explained in detail with reference to the attached drawings.

Referring to FIGS. 1 to 7, a cosmetic container 100 with a pallet 130 replaceable on the underside thereof includes: a container body 110 having a compartment frame 114 formed on top thereof to provide one or more compartmented exposed spaces 112 and a mounting space 116 open downward; a cap 120 openable and closable with respect to the container body 110 by means of a hinge 122 disposed on one side thereof; and the pallet 130 coupled or separated to or from the mounting space 116 of the container body 110 and having one or more compartmented cosmetic material filling spaces 132 filled with cosmetic materials 140, wherein the pallet 130 has elastic control pieces 134 facingly disposed on both side walls thereof, and the container body 110 has elastic control grooves 118 facingly formed on the inner surfaces of the side walls thereof correspondingly to the elastic control pieces 134, so that in a state where the cap 120 is closed, the container body 110 is directly pressurized against the pallet 130 to allow the mounting space 116 open downward to be coupled to the pallet 130, and as the elastic control pieces 134 elastically operate with an artificial force, the pallet 130 is separable from the mounting space 116 of the container body 110, thereby enabling the pallet 130 to be replaced with a refill pallet very conveniently.

The hinge 122, which serves to allow the cap 120 to be open and closed with respect to the container body 110, may have various shapes.

Figure 4:
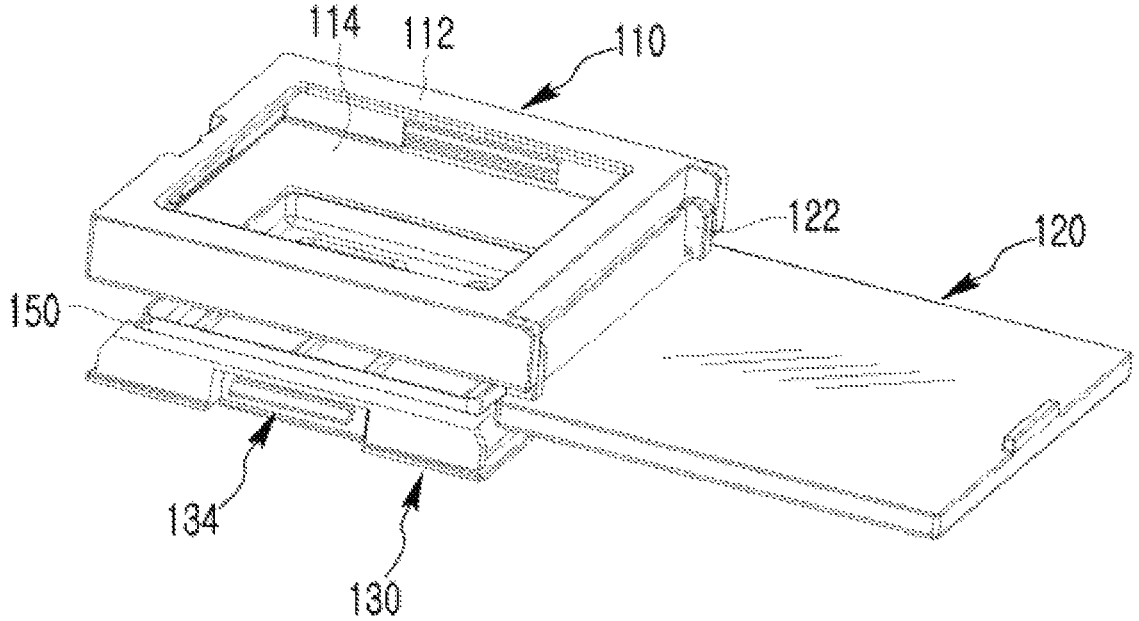
Figure 10:
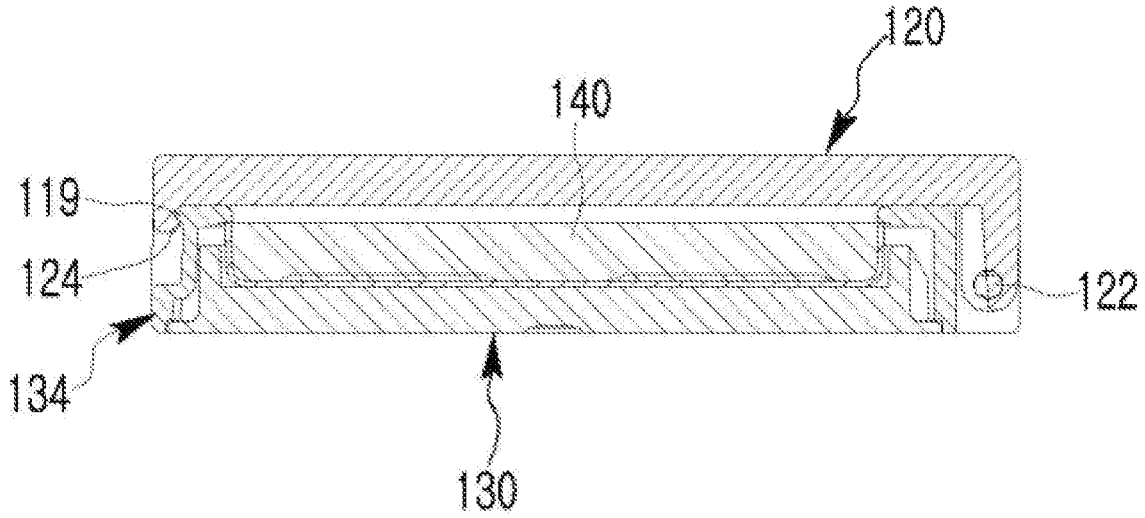
FIG. 10 is a sectional view taken along the line 10A-10A of FIG. 1.
Figure 11:
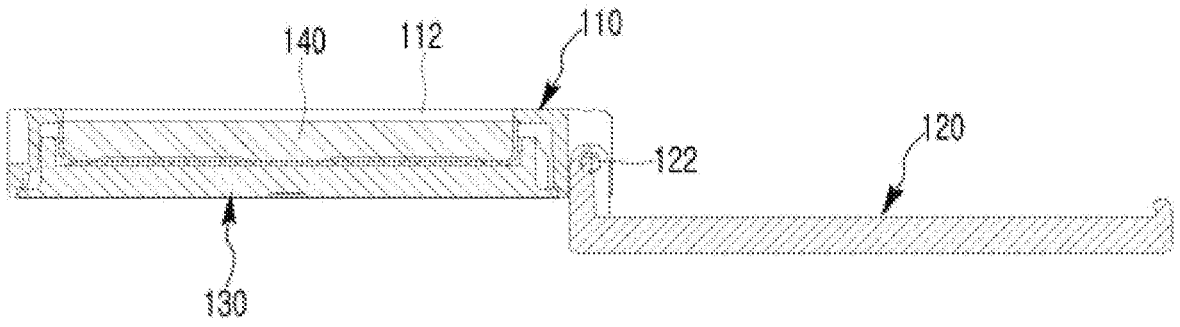
FIG. 11 is a sectional views showing a state where the cap is open in FIG. 10.

For example, as shown in FIGS. 4, 10, and 11, an injection pin is used as the hinge 122. In the case where the injection pin is used as the hinge 122, the injection pin is not made of a metal material, unlike conventional practices, and accordingly, the injection pin as the hinge 122 is separately collected, without any inconvenience. Further, the injection pin is eco-friendly, and even if it is thrown away, no environmental pollution occurs.

Figure 13:
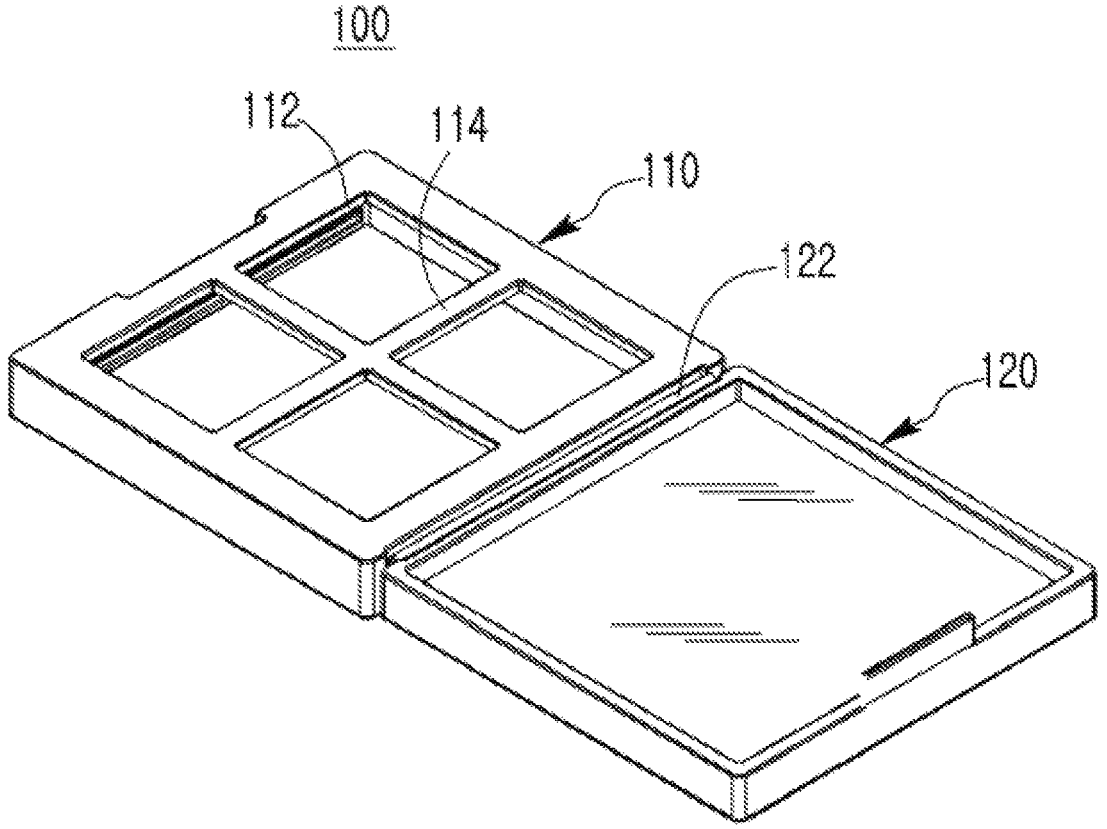
FIG. 13 is a perspective view showing an example where a hinge is formed integrally with the cosmetic container according to the present invention.

Further, as shown in FIG. 13, the hinge 122 is formed integrally with the container body 110 and the cap 120. In this case, the hinge 122 is made of the same material as the container body 110 and the cap 120 and integrally formed with them by means of injection molding.

If the hinge 122 is formed integrally with the container body 110 and the cap 120, it is possible that the hinge 122 is made as a single injection molded product together with the container body 110 and the cap 120, thereby reducing a mold manufacturing cost, requiring no coupling among them, and remarkably lowering a manufacturing cost of a product.

Figure 3:
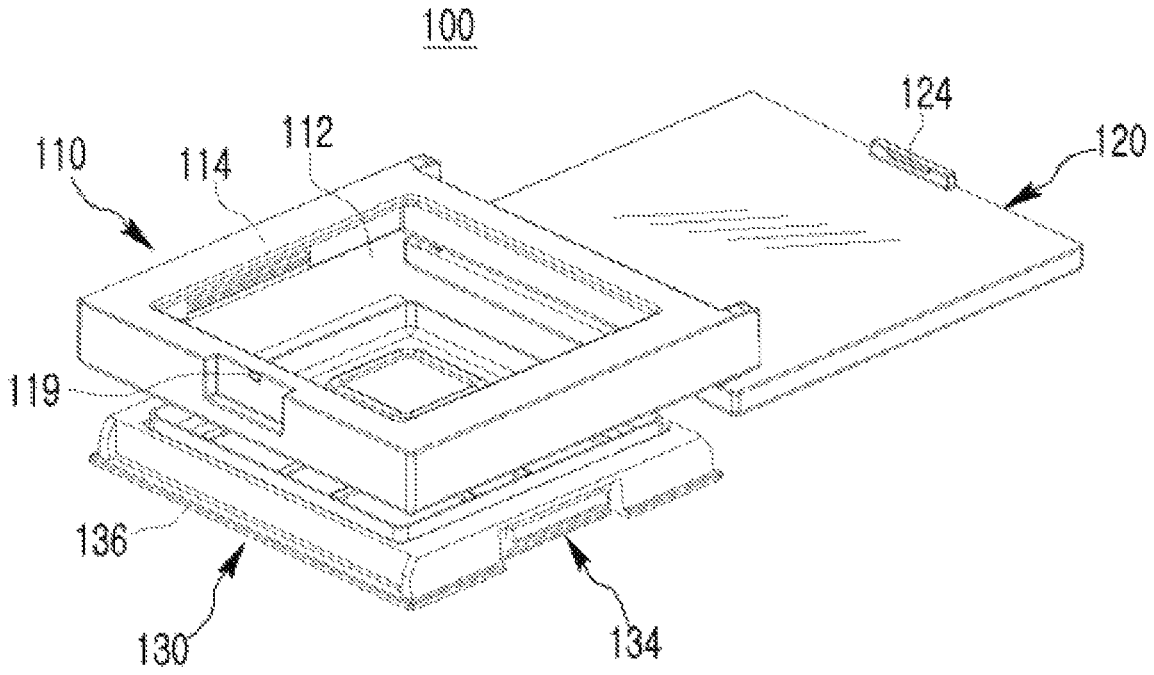
FIGS. 3 and 4 are perspective views showing a state where a cap is open after the pallet has been separated from the cosmetic container according to the present invention.

As shown in FIGS. 3 and 10, further, the cap 120, which is open and closed with respect to the container body 110, is prevented from being arbitrarily open by means of the interlocking between locking projections 119 and 124 formed correspondingly to each other on the container body 110 and the cap 120.

The locking projections 119 and 124 may be freely replaced with other components only if they have the same functions as the locking projections 119 and 124.

According to the present invention, the elastic control pieces 134 include elastic support pieces 134*a* spaced apart from both side facing walls of the pallet 130 and having freely extending bottom ends in a vertical direction, elastic locking projections 134*b* protruding from the outer peripheral surfaces of the elastic support pieces 134*a*, and inclined support surfaces 134*c* formed on tops of the elastic locking projections 134*b*, and the elastic control grooves 118 are adapted to allow the elastic locking projections 134*b* to be elastically locked and unlocked thereon and therefrom and include initial inclined entry portions 118*a* with inclined surfaces corresponding to the inclined support surfaces 134*c* formed on tops of the elastic locking projections 134*b*, so that the mounting space 116 of the container body 110 is directly pressurized against top of the pallet 130, and otherwise, when the pallet 130 is pushed and fitted to the open underside of the mounting space 116, the inclined support surfaces 134*c* formed on tops of the elastic locking projections 134*b* stably slide along the initial inclined entry portions 118*a* and come into contact with the elastic control grooves 118, thereby allowing the elastic control pieces 134 to be elastically locked onto the elastic control grooves 118.

Figure 8:
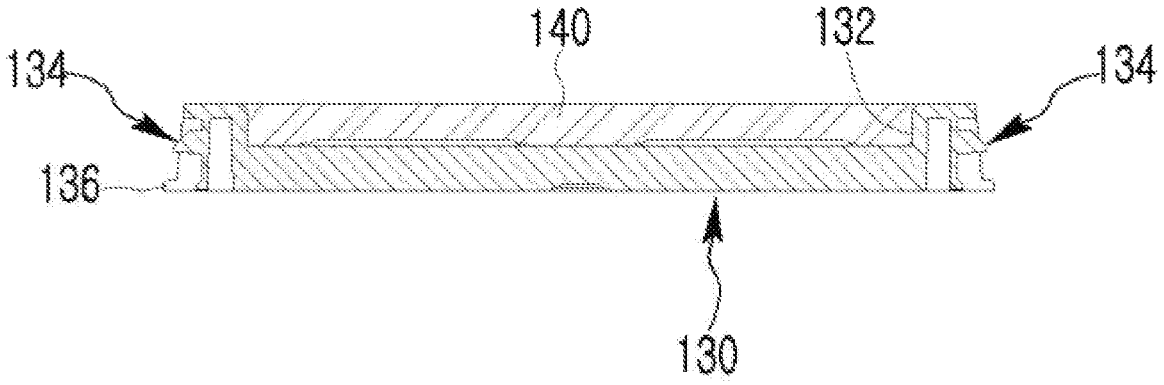
FIG. 8 is a sectional view showing a state where cosmetic materials are directly filled in cosmetic material filling spaces of the pallet in FIG. 7.
Figure 9:
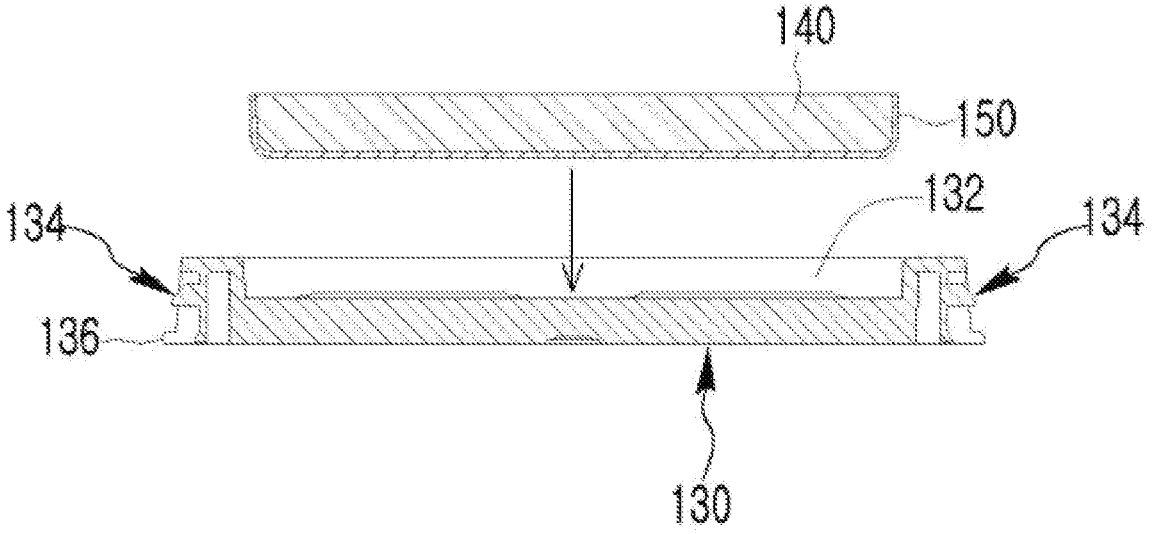
FIG. 9 is a sectional view showing a state where dishes in which the cosmetic materials are filled are accommodated in the cosmetic material filling spaces of the pallet in FIG. 7.

According to the present invention, further, the cosmetic materials 140, which are filled in the cosmetic material filling spaces 132 of the pallet 130, are directly filled, as shown in FIG. 8, and otherwise, the cosmetic materials 140 are filled in dishes 150 separately prepared so that the dishes 150 are accommodated in the cosmetic material filling spaces 132.

In the case where the cosmetic materials 140 are accommodated after filled in the dishes 150, the dishes 150 are made of the same material as the pallet 130 or a recyclable synthetic resin or metal, thereby providing advantages of separate collection or recycling.

Figure 12:
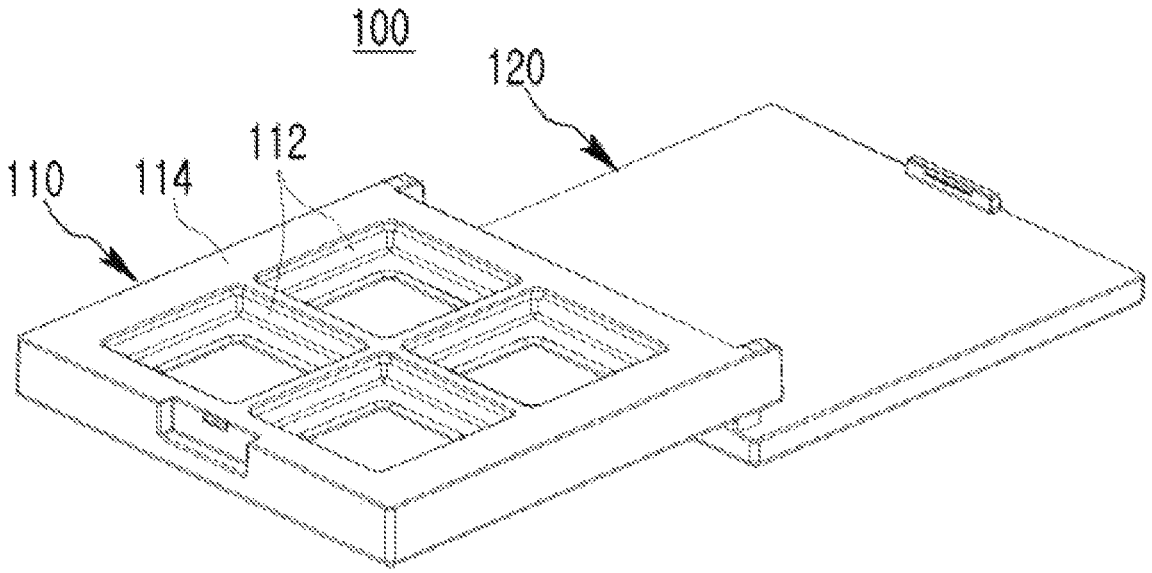
FIG. 12 is a perspective view showing an example where one or more exposed spaces are formed in the cosmetic container according to the present invention.

According to the present invention, as shown in FIG. 12, the one or more cosmetic material filling spaces 132 compartmented on top of the pallet 130 are formed correspondingly to the exposed spaces 112 formed on the compartment frame 114 of the container body 110, and otherwise, they may have various shapes.

Accordingly, the cosmetic material filling spaces 132 are exposed to the outside through the exposed spaces 112 of the container body 110 and do not cause any interference when the cosmetic materials 140 are used, so that in a state where the cap 120 of the container body 110 is open, it is possible that the cosmetic materials 140 are applied to a makeup tool through the exposed spaces 112.

According to the present invention, the pallet 130 has locking edges 136 extending outward from the outer sides of the underside thereof, and the container body 110 has base stepped projections 117 formed on the inner surfaces of the open underside of the mounting space 116 to insertedly seat the locking edges 136 thereonto, so that when the pallet 130 is coupled to the mounting space 116 of the container body 110, the locking edges 136 are stably fitted to the base stepped projections 117.

When the pallet 130 is coupled to the mounting space 116 of the container body 110, the locking edges 136 are supportedly seated onto the base stepped projections 117, thereby making the coupled state maintained stably.

According to the present invention, further, the areas of the cosmetic material filling spaces 132 of the pallet 130 are larger than those of the exposed spaces 112 of the container body 110, so that the edges of the cosmetic materials 140 accommodated in the cosmetic material filling spaces 132 or tops of the dishes 150 for filling the cosmetic materials 140 are locked onto the underside of the compartment frame 114 of the container body 110 and thus prevented from escaping upward.

Figure 5:
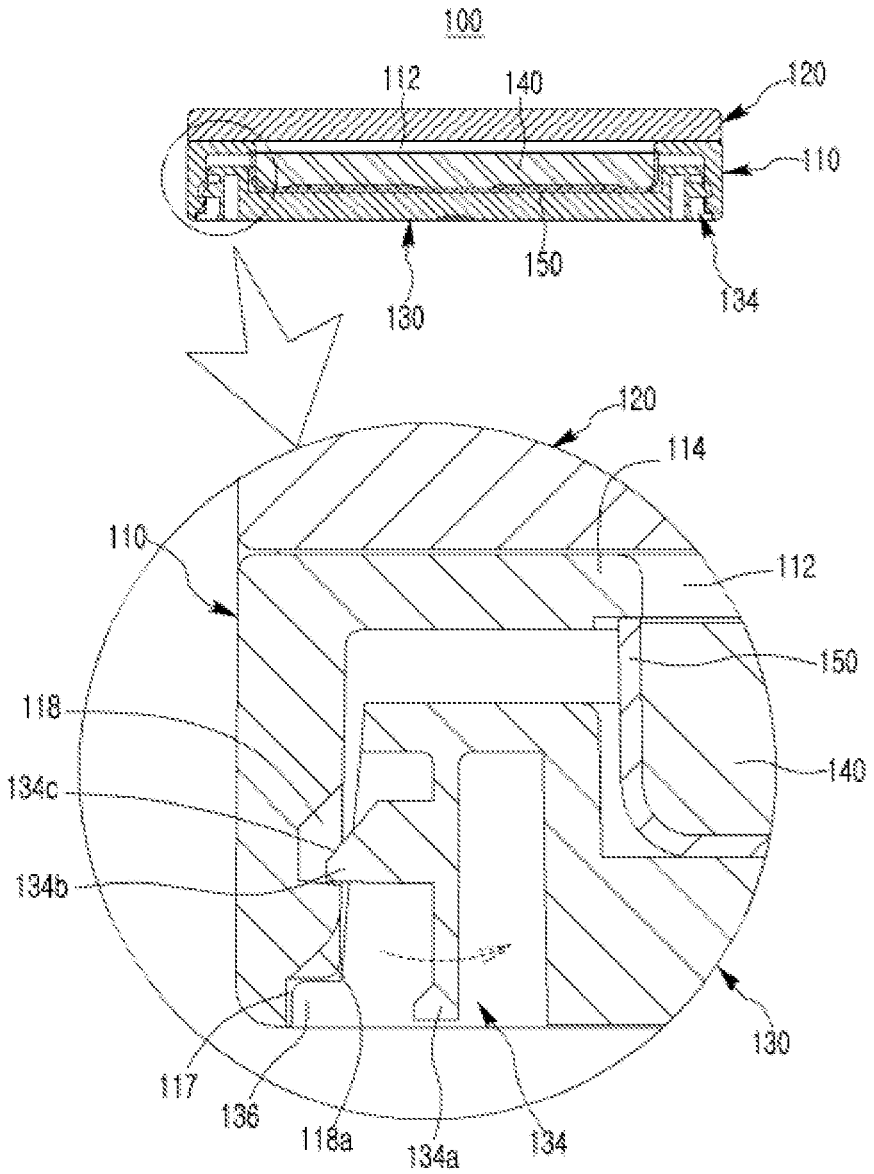
FIG. 5 is a sectional view taken along the line 5A-5A of FIG. 1.

Under the above-mentioned configuration, if the cosmetic materials 140 are accommodated in the cosmetic material filling spaces 132 of the pallet 130, especially in the state of being filled in the dishes 150, the tops of the dishes 150 are locked onto the underside of the compartment frame 140, as shown in FIG. 5, and thus prevented from escaping upward. Accordingly, the dishes 150 are stably accommodatedly supported against the container body 110, even without any bonding to the bottoms of the cosmetic material filling spaces 132 by means of the adhesive in the conventional practice, thereby causing no environmental pollution and requiring no separate coupling process using the adhesive.

Moreover, the dishes 150 are accommodatedly supported against the cosmetic material filling spaces 132 of the pallet 130, without any separate attaching means, so that after the cosmetic materials 140 are consumed up, the pallet 130 and the dishes 150 are quickly and easily separately collected from the container body 110.

Now, an explanation of the coupled state of the pallet 130 filled with the cosmetic materials 140 to the mounting space 116 formed on the container body 110 in the cosmetic container 100 according to the present invention will be given.

According to the present invention, the mounting space 116 of the container body 110 is open downward. Accordingly, if necessary, it is possible to push the pallet 130 under the mounting space 116 toward the mounting space 116 and thus fit the pallet 130 to the mounting space 116, but according to the present invention, basically, it is desirable that the container body 110 is directly pressurized against the pallet 130 and coupled to the pallet 130.

Figure 6:
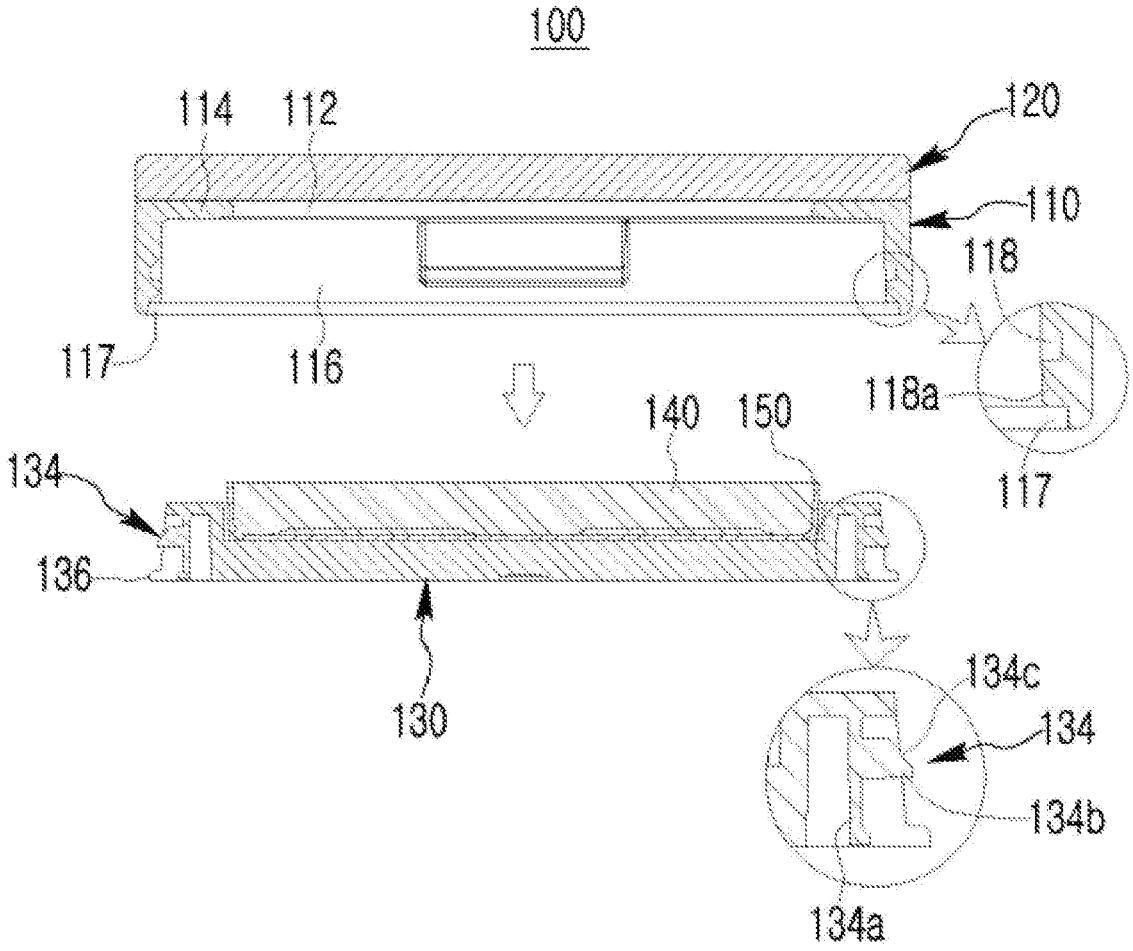
FIG. 6 is a sectional view showing a state before a container body is coupled to the pallet in the cosmetic container according to the present invention.
Figure 7:
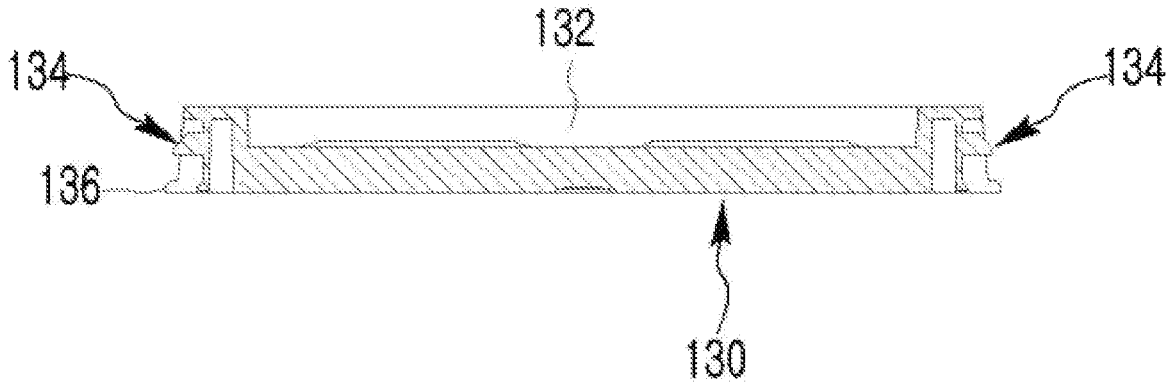
FIG. 7 is a sectional view showing the pallet in the cosmetic container according to the present invention.

In specific, the mounting space 116 is open downward with respect to the container body 110, and accordingly, the cosmetic materials 140 are first filled in the cosmetic material filling spaces 132 of the pallet 130, or the dishes 150 filled with the cosmetic materials 140 are accommodated in the cosmetic material filling spaces 132 of the pallet 130. In this case, as shown in FIG. 6, in the state where the cap 120 is closed with respect to the container body 110, the container body 110 is directly pressurized against the pallet 130 to allow the pallet 130 to be coupled to the mounting space 116 open downward.

In the case where the container body 110 is directly pressurized against the pallet 130, the initial inclined entry portions 118*a* of the elastic control grooves 118 come into contact with the inclined support surfaces 134*c* formed on tops of the elastic locking projections 134*b* protruding from the elastic support pieces 134*a* of the elastic control pieces 134 and thus move to be forcedly pressurized inwardly. Simultaneously, the elastic locking projections 134*b* protruding from the elastic support pieces 134*a*, while moving over the initial inclined entry portions 118*a*, are elastically locked onto the elastic control grooves 118.

According to the present invention, the mounting space 116 is open downward with respect to the container body 110, and accordingly, even if the container body 110 is provided in the state where the cap 120 is closed with respect to the container body 110, the container body 110 is directly pressurized against the pallet 130 and coupled to the pallet 130 in the state where the cap 120 is not open, so that the packaging work of the pallet 130 can be performed quickly, easily, and conveniently. Further, the pallet 130, which is coupled to the interior of the mounting space 116, is forcedly elastically locked onto the mounting space 116 by means of the elastic control pieces 134 and the elastic control grooves 118, so that unless the elastic control pieces 134 are artificially released from their locked state, they can be kept elastically locked onto the elastic control grooves 118.

In the case where the cosmetic materials 140 filled in the pallet 130 coupled to the mounting space 116 of the container body 110 are used to apply make-up, as shown in FIG. 11, the cap 120 is open, and next, the cosmetic materials 140, which are exposed to the outside through the exposed spaces 114 of the compartment frame 114, are applied appropriately to the makeup tool.

If the cosmetic materials 140 filled in the pallet 130 are consumed up, the pallet 130 has to be replaced with a refill pallet, and in this case, the elastic support pieces 134*a* of the elastic control pieces 134 exposed to the outside are pressurized inward (in the direction of an arrow of the enlarged portion of FIG. 5) to allow the elastic locking projections 134*b* to be released from the locked states onto the elastic control grooves 118, so that the pallet 130 is separated from the mounting space 116 of the container body 110 and thus replaced with the refill pallet.

In this case, even if any one of the elastic support pieces 134*a* of the elastic control pieces 134 or both of them are pressurized inward, the pallet 130 is separated from the mounting space 116 of the container body 110 and thus replaced with the refill pallet.

According to the present invention, the container body 110 and the cap 120 are used permanently, and only the pallet 130 is replaced with the refill pallet, thereby having some advantages of the reduction of waste parts through recycling, the prevention of waste of resources, the enhancement of reuse or recycling rate of the resources, and the suppression of environmental pollution. Further, consumers purchase only the pallets, thereby having economical advantages of the reduction of cosmetic product purchasing costs.

In the case where the dishes 150 filled with the cosmetic materials 140 are accommodated in the cosmetic material filling spaces 132 of the pallet 130, it is possible that if necessary, only the dishes 150 are replaced with new ones, and in this case, it is possible to permanently use the pallet 130, thereby greatly improving the recycling rate of the resource.

As described above, the cosmetic container according to the present invention has the elastic control pieces facingly formed on both side walls of the pallet and the elastic control grooves facingly formed on the corresponding inner surfaces of the side walls of the container body with the mounting space open on the underside thereof, so that in the packaging line, even in the state where the cap coupled to the container body is not open, the container body can be directly pressurized against the pallet filled with the cosmetic materials to thus couple the pallet to the mounting space, thereby ensuring high assemblability of the product and the improvement in the coupling process of the product, and the elastic control pieces artificially operate elastically from the underside of the container body, thereby ensuring the quick, easy, and simple replacement of the pallet with the refill pallet.

Moreover, even if the dishes filled with the cosmetic materials are accommodated in the pallet, they are not bonded to the pallet using the adhesive, so that the dishes can be separately collected after the cosmetic container has been used up, thereby enhancing the recycling or reusable rate of the resources and providing eco-friendly effectiveness such as reduction of environmental pollution.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cosmetic container comprising:

a container body having:

a compartment frame having one or more compartmented exposed spaces, and a mounting space open downward from the compartment frame;

a cap coupled to the container body by a hinge and configured to be opened or closed with respect to the container body by the hinge; and a pallet configured to be coupled to or separated from the mounting space of the container body and having one or more compartmented cosmetic material filling spaces, the one or more compartmented cosmetic material filling spaces being configured to be filled with cosmetic materials;

wherein the pallet has a first elastic control piece disposed at one side wall of the pallet and a second elastic control piece disposed at another side wall of the pallet that is opposite to the one side wall of the pallet, wherein the container body has a first elastic control groove defined on one inner wall surface of the container body and a second elastic control groove defined on another inner wall surface of the container body opposite to the one inner wall surface of the container body, wherein the first elastic control groove and the second elastic control groove are configured to be coupled with the first elastic control piece and the second elastic control piece, respectively, when the container body is pressurized against the pallet to allow the mounting space to be coupled to the pallet, wherein the first elastic control groove and the second elastic control groove are configured to separate the pallet from the mounting space of the container body when the first elastic control piece and the second elastic control piece are released from the first elastic control groove and the second elastic control groove, respectively, to replace the pallet with a refill pallet, wherein the first elastic control piece comprises:

a first elastic support piece spaced apart from the one side wall of the pallet and extending downward from a top portion of the pallet in a vertical direction to a free bottom end; and a first elastic locking projection protruding from an outer peripheral surface of the first elastic support piece and positioned at an intermediate region between the top portion of the pallet and the free bottom end of the first elastic support piece, wherein the first elastic locking projection is configured to be inserted into the first elastic control groove, wherein the second elastic control piece comprises:

a second elastic support piece spaced apart from the another side wall of the pallet and extending downward from the top portion of the pallet in the vertical direction to a free bottom end of the second elastic support piece; and a second elastic locking projection protruding from an outer peripheral surface of the second elastic support piece and positioned at an intermediate region between the top portion of the pallet and the free bottom end of the second elastic support piece, wherein the second elastic locking projection is configured to be inserted into the second elastic control groove, wherein the pallet has locking edges extending outward from outer sides of an underside of the pallet, and the container body has base stepped projections stepped inward by a thicknesses of the locking edges on inner surfaces of an open underside of the mounting space to seat the locking edges thereinto, wherein the locking edges extending outward from the outer sides of the underside of the pallet protrude more outward than the first and second elastic locking projections when viewed from a top of the cosmetic container, such that distal ends of the locking edges are disposed more outward than a distal end of each of the first and second elastic locking projections, wherein the first and second elastic locking projections each has an inclined support surface defined on top thereof, the inclined support surface inclining downward toward the distal end of each of the first and second elastic locking projections, and each of the first and second elastic control grooves has an initial inclined entry portion with an inclined surface corresponding to the inclined support surface of each of the first and second elastic locking projections, respectively, wherein a thickness of the first elastic support piece is less than a thickness of the one side wall of the pallet, and a thickness of the second elastic support piece is less than a thickness of the another side wall of the pallet, wherein the distal end of each of the first elastic locking projection and the second elastic locking projection has a flat surface extending in a direction parallel to an innermost surface of each of the first elastic control groove and the second elastic control groove, respectively, wherein the first elastic control groove and second elastic control groove each has therein another inclined surface inclining from the respective inner wall surface to the respective innermost surface to correspond to the inclined support surface of the first and second elastic locking projections, respectively, when the first elastic locking projection and the second elastic locking projection are inserted into the first elastic control groove and the second elastic control groove, respectively, wherein each of the first and second initial inclined entry portions is recessed with respect to the respective inner wall surface of the container body.

2. The cosmetic container according to claim 1, wherein the one or more compartmented cosmetic material filling spaces of the pallet is configured to directly accommodate the cosmetic materials.

3. The cosmetic container according to claim 1, wherein the one or more compartmented cosmetic material filling spaces of the pallet are defined correspondingly to the one or more compartmented exposed spaces defined on the compartment frame of the container body.

4. The cosmetic container according to claim 2, wherein areas of the one or more compartmented cosmetic material filling spaces of the pallet are larger than areas of the one or more compartmented exposed spaces of the container body, so that edges of the cosmetic materials accommodated in the one or more compartmented cosmetic material filling spaces are locked onto an underside of the compartment frame of the container body to be prevented from escaping upward.

5. The cosmetic container according to claim 1, wherein when the mounting space of the container body is pushed toward the pallet from above while the pallet remains stationary, the inclined support surface of the first elastic locking projection and the inclined support surface of second elastic locking projection are configured to slide along the initial inclined entry portion of the first elastic control groove and the initial inclined entry portion of the second elastic control groove, respectively, wherein the first and second elastic locking projections are configured to be inserted into the first elastic control groove and the second elastic control groove, respectively, thereby allowing the first and second elastic control pieces to be elastically locked onto the first and second elastic control grooves, respectively.

* * * * *